US011319614B2

(12) United States Patent
Matsuwaka et al.

(10) Patent No.: US 11,319,614 B2
(45) Date of Patent: May 3, 2022

(54) METHOD FOR DEOXIDIZING AL—NB—TI ALLOY

(71) Applicant: Kobe Steel, Ltd., Kobe (JP)

(72) Inventors: Daisuke Matsuwaka, Hyogo (JP); Fumiaki Kudo, Hyogo (JP); Tetsushi Deura, Hyogo (JP); Hitoshi Ishida, Hyogo (JP); Koichi Sakamoto, Hyogo (JP)

(73) Assignee: Kobe Steel, Ltd., Kobe (JP)

( * ) Notice: Subject to any disclaimer, the term of this patent is extended or adjusted under 35 U.S.C. 154(b) by 269 days.

(21) Appl. No.: 15/522,062

(22) PCT Filed: Nov. 4, 2015

(86) PCT No.: PCT/JP2015/081093
§ 371 (c)(1),
(2) Date: Apr. 26, 2017

(87) PCT Pub. No.: WO2016/072434
PCT Pub. Date: May 12, 2016

(65) Prior Publication Data

US 2017/0335431 A1 Nov. 23, 2017

(30) Foreign Application Priority Data

Nov. 4, 2014 (JP) ..... JP2014-224360
Apr. 7, 2015 (JP) ..... JP2015-078626
Aug. 12, 2015 (JP) ..... JP2015-159315

(51) Int. Cl.
*C22C 1/02* (2006.01)
*C22B 9/10* (2006.01)
(Continued)

(52) U.S. Cl.
CPC ..... *C22C 1/026* (2013.01); *C22B 9/10* (2013.01); *C22B 9/20* (2013.01); *C22C 1/02* (2013.01); *C22C 21/00* (2013.01)

(58) Field of Classification Search
CPC ..... C22C 1/026; C22C 1/02; C22C 21/00; C22B 9/10; C22B 9/20
See application file for complete search history.

(56) References Cited

U.S. PATENT DOCUMENTS 5,102,450 A 4/1992 Huang
2008/0069720 A1 3/2008 Renkel et al.
2017/0283906 A1 10/2017 Kudo et al.

FOREIGN PATENT DOCUMENTS

JP H03285757 * 4/1990
JP 4-120225 A 4/1992
(Continued)

OTHER PUBLICATIONS

Lin, J.p., et al. "Effect of Nb on Oxidation Behavior of High Nb Containing TiAl Alloys." Intermetallics, vol. 19, No. 2, 2011, pp. 131-136 (Year: 2011).*
(Continued)

*Primary Examiner* — Paul A Wartalowicz
*Assistant Examiner* — Ryan L Heckman
(74) *Attorney, Agent, or Firm* — Oblon, McClelland, Maier & Neustadt, L.L.P.

(57) ABSTRACT

Disclosed herein is a method for deoxidizing an Al—Nb—Ti alloy, which includes melting and holding an Al—Nb—Ti alloy containing from 50 to 75 mass % of Al, from 5 to 30 mass % of Nb, and 80 mass % or less in total of Al and Nb by a melting method using a water-cooled copper vessel in an atmosphere of 1.33 Pa to $2.67\times10^5$ Pa at a temperature of 1,900 K or more, thereby decreasing an oxygen content thereof. The Al—Nb—Ti alloy is prepared using an alloy material formed of an aluminum material, a niobium mate-
(Continued)

rial and a titanium material and containing oxygen in a total amount of 0.5 mass % or more.

13 Claims, 2 Drawing Sheets

(51) Int. Cl.
*C22B 9/20* (2006.01)
*C22C 21/00* (2006.01)

(56) References Cited

FOREIGN PATENT DOCUMENTS

| | | | |
|---|---|---|---|
| JP | 5-59466 | | 3/1993 |
| JP | 5-154642 | A | 6/1993 |
| JP | 5-195102 | A | 8/1993 |
| JP | H0559466 | B2 * | 8/1993 |
| JP | 8-283890 | A | 10/1996 |
| JP | 11-293433 | A | 10/1999 |
| WO | WO 2016/035824 | A1 | 3/2016 |

OTHER PUBLICATIONS

R.A. Beall, "Cold-Mold Arc Melting and Casting" Bureau of Mines 646, pp. 50-65, (1968) (Year: 1968).*
JPH03285757 Machine Translation (Year: 1990).*
JPH0559466 Machine Translation (Year: 1993).*
Guo, Jingjie, et al. "Evaporation Behavior of Aluminum during the Cold Crucible Induction Skull Melting of Titanium Aluminum Alloys." Metallurgical and Materials Transactions B, vol. 31, No. 4, 2000, pp. 837-844 (Year: 2000).*
Friedrich, Bernd. "The 10th World Conference on Titanium."A New Processing Route for Titanium Alloys by Aluminothermic Reduction of Titanium Dioxide and Refining by ESR, 2003, pp. 1-3 (Year: 2003).*
Mickle, T T, et al. "Microstructural Characterization of Melt-Spun of Al3Ti—Nb Intermetallics." Melt-Spinning and Strip Casting: Research and Implementation, No. 420, Mar. 1, 1992, pp. 183-199 (Year: 1992).*
Friedrich B, Morscheiser J, Reitz J, Lochbichler C. Recycling of titanium-aluminide scrap. Titanium 2009. Hawaii, USA: ITA; Sep. 13e16, 2009 (Year: 2009).*
WACKER Service Guide (Year: 2018).*
Nakajima, Tadahito, et al. "Purification of Ti—Al Alloys by Induction-Heating Floating-Zone Melting and Cold-Crucible Melting in Ultra-High Vacuum." Materials Transactions, JIM, vol. 41, No. 1, 2000, pp. 22-27 (Year: 2000).*
Extended European Search Report dated Mar. 9, 2018 in European Patent Application No. 15856211.6, 10 pages.
Hammerschmidt, J. et al. "Elektroschlackeschmelzen von aluminothermisch hergestellten Titan-Aluminiumlegierungen-Eine Alternative zum Kroll-Prozess", Berg-Und Hüttenmännischen Monatshefte (BHM) vol. 146, No. 5, XP009503649, Dec. 31, 2001, pp. 203-209.
International Search Report and Written Opinion dated Jan. 26, 2016 in PCT/JP2015/081093.
Guo, J., et al., "Evaporation Behavior of Aluminum during the Cold Crucible Induction Skull Melting of Titanium Aluminum Alloys", Metallurgical and Materials Transactions B, XP19697088, vol. 31B, Aug. 2000, pp. 837-844.

* cited by examiner

METHOD FOR DEOXIDIZING AL—NB—TI ALLOY

TECHNICAL FIELD

The present invention relates to a deoxidation method of an Al—Nb—Ti alloy for removing oxygen from an Al—Nb—Ti alloy manufactured using an alloy material that is composed of an aluminum material, a niobium material and a titanium material and contains oxygen in a total amount of 0.5 mass % or more.

BACKGROUND ART

In recent years, demand for a Ti—Al alloy as a metal material for airplanes or automobiles is growing. Among others, demand for a Ti—Al—Nb alloy having more enhanced oxidation resistance by adding Nb to Ti—Al is increasing. When titanium alloy of which main component is titanium that is an active metal, such as Ti—Al—Nb alloy, is produced, it is indispensable to prevent contamination by oxygen during melting, and a melting method such as vacuum arc remelting method (VAR), electron beam melting method (EB), plasma arc melting method (PAM), vacuum induction melting method (VIM) and cold crucible induction melting method (CCIM) has been conventionally employed.

Among these melting methods, the melting method such as VAR, EB and VIM is a melting method of melting an alloy in a vacuum atmosphere and when such a melting method is employed for inciting a Ti—Al—Nb alloy, not only Al or Nb as an alloy element but also Ti are evaporated during melting to cause an element loss. More specifically, it is very difficult in the current industrial process to control the Ti—Al—Nb alloy to have a target composition, resulting in a rise of the production cost.

For the smelting of a Ti—Al—Nb alloy having a low oxygen content, production of a Ti—Al—Nb alloy by use of a high-grade niobium or titanium material having a low oxygen content is effective, but since the high-grade niobium material is expensive and its price tends to rise particularly in recent years, a need to produce a Ti—Al—Nb alloy by use of a relatively low-grade niobium material having a large oxygen content and being inexpensive, such as lower niobium, niobium oxide ore ($Nb_2O_5$) and scrap raw material, is increasing day by day. As with the niobium material, a high-grade titanium material is expensive, and needs for use of a relatively low-grade titanium material, such as scrap raw material, is also increasing.

Ti is an active metal and has a very strong bonding force to oxygen present in the melting atmosphere, and measures to deal with how to decrease the amount of oxygen entering from the outside during melting and prevent contamination have been heretofore taken. However, it is not easy to remove oxygen once dissolved in Ti, and although little is known at present about the effort therefor itself, the related art includes the following proposals.

Patent Document 1 discloses a method for melting a γ-titanium aluminide, including a step of melting, in a calcium oxide-made crucible, a charging material composed of a titanium aluminide alloy and a metal such as niobium in an amount effective for reducing oxygen intake into the melt, but only a melting method for a Ti—Al—Nb alloy is merely described, and a technique regarding a deoxidation method for a Ti—Al—Nb alloy is neither described nor suggested. In addition, the niobium raw material used is a high-purity material with a purity of 99.9% or more, and the oxygen concentration of the Ti—Al—Nb alloy after melting is a concentration not requiring deoxidation.

Patent Document 2 describes a production method of a Ti—Al alloy, including melting a Ti—Al alloy in a lime crucible in vacuum or in an inert atmosphere, adding Ca or a Ca-containing alloy to the melted Ti—Al alloy, and performing a deoxidation treatment. Patent Document 2 certainly describes a technique regarding the deoxidation method of a Ti—Al alloy, but even use of a niobium material is neither described nor suggested, let alone use of a niobium material with a high oxygen content.

Patent Document 3 describes a method for producing a high-purity and low-oxygen Ti—Al alloy by, in the smelting of an alloy containing Ti—Al as its main component, deoxidizing the alloy with Ca, evaporating/removing excess Ca, and performing contamination-free uniform melting. However, in Patent Document 3 as well, even use of a niobium material is not described, and the method for deoxidizing a Ti—Al—Nb alloy is neither described not suggested. In addition, according to the technique described in Patent Document 3, two steps of adding/melting of Ca and melting for removal of Ca and homogenization are required and moreover, remaining Ca cannot be completely removed, raising a concern about the increase in the production cost/time and the change in various properties due to remaining Ca.

PRIOR ART DOCUMENT

Patent Document

Patent Document 1: JP-A-H05-195102
Patent Document 2: JP-A-H04-120225
Patent Document 3: JP-A-H05-154642

SUMMARY OF INVENTION

Technical Problem

The present invention has been made to solve the above-described conventional problems, and an object of the present invention is, by focusing attention first on the production of an Al—Nb—Ti alloy containing Al as its main component and having a low oxygen content, to provide a deoxidation method of a Al—Nb—Ti alloy, in which a Ti—Al—Nb alloy having a target composition and a low oxygen content can be easily produced without creating a high vacuum atmosphere.

Solution to Problem

The method for deoxidizing an Al—Nb—Ti alloy in the present invention includes melting and holding an Al—Nb—Ti alloy containing from 50 to 75 mass % of Al, from 5 to 30 mass % of Nb, and 80 mass % or less in total of Al and Nb by a melting method using a water-cooled copper vessel in an atmosphere of 1.33 Pa to $2.67\times10^5$ Pa at a temperature of 1,900 K or more, thereby decreasing an oxygen content thereof, the Al—Nb—Ti alloy being prepared using an alloy material composed of an aluminum material, a niobium material and a titanium material and containing oxygen in a total amount of 0.5 mass % or more.

It is preferred that a $CaO—CaF_2$ flux obtained by blending from 0 mass % to 95 mass % of calcium fluoride with calcium oxide is added during melting of the Al—Nb—Ti alloy by the melting method using the water-cooled copper vessel.

It is preferred that, the melting method using the water-cooled copper vessel is any one of an arc melting method, a plasma arc melting method and an induction melting method.

Advantageous Effects of Invention

According to the deoxidation method of an Al—Nb—Ti alloy of the present invention, the content of Al in the melt is set to a high concentration of 50 to 75 mass %, so that even when a high vacuum atmosphere is not created, an Al—Nb—Ti alloy having a target composition and a low oxygen content can be easily produced by using a low-grade inexpensive niobium material having a high oxygen content while causing substantially no volatilization loss of Al, Nb and Ti during melting. An appropriate amount of this Al—Nb—Ti alloy having a low oxygen content is mixed with Ti having a low oxygen content, whereby a desired Ti—Al—Nb alloy containing Ti as its main component can be obtained at a relatively low cost.

DESCRIPTION OF EMBODIMENTS

Figure 1:
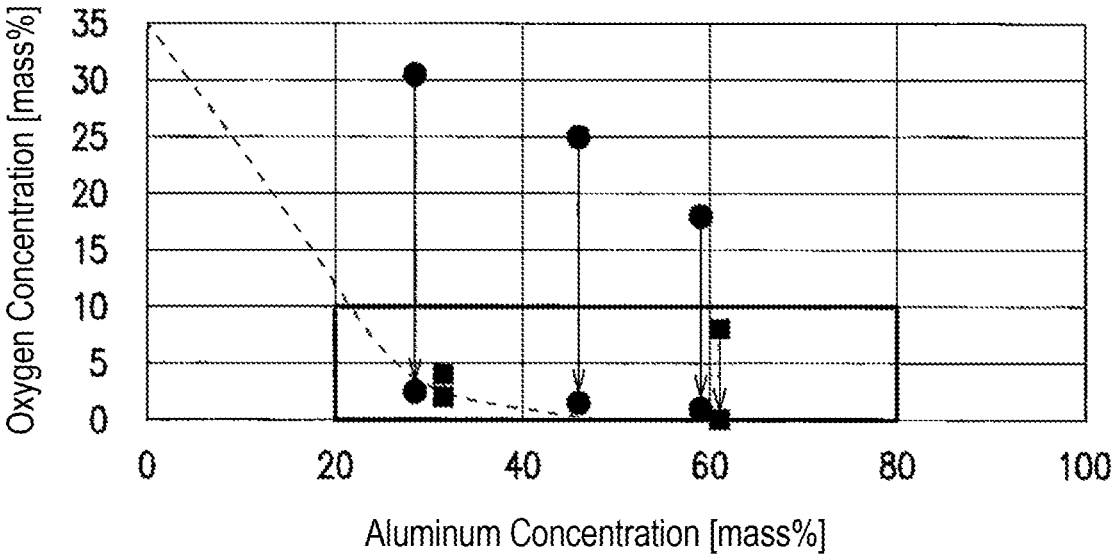
FIG. 1 A graph diagram illustrating the relationship between the Al content in an Al—Nb—Ti alloy and the oxygen content before and after melting.

The present inventors have made intensive studies to obtain a Ti—Al—Nb alloy (a Ti—Al—Nb alloy of which main component being titanium that is an active metal) having a target composition and a low oxygen content by using the above-described low-grade niobium material having a high oxygen content.

As a result, they have conceived that while it is difficult for technical and cost reasons to reduce the oxygen content in conjunction with previously controlling the alloy to a desired composition, i.e., to an alloy composition containing titanium as its main component, when the process thereof is divided and after an Al—Nb—Ti alloy having a low oxygen content and containing aluminum as its main component is prepared, the Al—Nb—Ti alloy having a low oxygen content is mixed with an appropriate amount of pure Ti having a low oxygen content obtained by a normal production method, a Ti—Al—Nb alloy having a desired composition and containing titanium as its main component may be obtained relatively in an easy and low-cost manner.

The present inventors have found that the soluble oxygen concentration (solubility limit) decreases in a composition range of containing high-concentration Al in an alloy, and made intensive studies to find a method where even when a high vacuum atmosphere is not created, an Al—Nb—Ti alloy having a target composition and a low oxygen content can be easily produced by using a low-grade niobium or titanium material containing a lot of oxygen, such as lower niobium, niobium oxide ore ($NbO_x$) and scrap raw material, while causing no volatilization losses of Al, Nb and Ti.

More specifically, it has been found that when the content of Al in the melt is set as high as 50 to 75 mass %, even in an Al—Nb—Ti alloy prepared using a low-grade niobium or titanium material, a deoxidation reaction proceeds during melting in a water-cooled copper vessel without creating a high vacuum atmosphere and a low-oxygen Al—Nb—Ti alloy having a target composition can be easily produced while causing substantially no volatilization loss of Al, Nb and Ti. The present invention has been accomplished based on this finding.

In addition, it has also been found that when a CaO—$CaF_2$ flux not dissolving in titanium and having a specific component composition is added as a deoxidation reaction accelerator before or during melting of an Al—Nb—Ti alloy, the deoxidation reaction proceeds more unfailingly.

The present invention is described in more detail below based on embodiments.

The deoxidation method of an Al—Nb—Ti alloy of the present invention is a method where an Al—Nb—Ti alloy containing from 50 to 75 mass % of Al, from 5 to 30 mass % of Nb, and 80 mass % or less in total of Al and Nb, prepared using an alloy material composed of an aluminum material, a niobium material and a titanium material and containing oxygen in a total amount of 0.5 mass % or more is melted and held by a melting method using a water-cooled copper vessel, such as arc melting method, plasma arc melting method and induction melting method, in an atmosphere of 1.33 Pa to $2.67\times10^5$ Pa at a temperature of 1,900 K or more and the oxygen content is thereby decreased. A low-grade niobium material such as lower niobium, niobium oxide ore ($NbO_x$) and scrap raw material may be used as the niobium material, and titanium oxide ($TiO_x$), scrap raw material, etc., may be used as the titanium material.

As the reason why a low-grade niobium material having a high oxygen content, such as lower niobium, niobium oxide ore ($NbO_x$) and scrap raw material, is used for the preparation of an Al—Nb—Ti alloy, these niobium materials are inexpensive and easy to procure, compared with a high-grade raw material. As the reason why the total content of oxygen in an alloy material composed of an aluminum material, a niobium material and a titanium material is set to be 0.5 mass % or more, when the total content of oxygen in the alloy material is less than 0.5 mass %, the oxygen content is slight and a low-oxygen Al—Nb—Ti alloy can be easily obtained by performing dilution or simple refining. In the present invention, the upper limit of the oxygen content is not specified, but the upper limit of the total content of oxygen actually contained in the alloy material above is considered to be about 30.0 mass %.

As the reason why in an Al—Nb—Ti alloy prepared using the alloy material composed of an aluminum material, a niobium material and a titanium material, the Al content is set to be from 50 to 75 mass %, the Nb content is set to be from 5 to 30 mass %, and the total content of Al and Nb is set to be 80 mass % or less, when the Al content in the Al—Nb—Ti alloy is 50 mass % or more and the Nb content is 5 mass % or more, a deoxidation reaction of the Al—Nb—Ti alloy is allowed to proceed by a melting method using a water-cooled copper vessel, such as arc melting method, plasma arc melting method and induction melting method, even in an atmosphere of 1.33 Pa to $2.67\times10^5$ Pa and not in a high vacuum atmosphere. In addition, as the reason why the pressure during melting is set to be from 1.33 Pa to $2.67\times10^5$ Pa, at the pressure in this range, volatilization loss of Al, Nb and Ti is not caused and reduction in the yield due to scattering of molten metal can be prevented.

The deoxidation reaction is a phenomenon developed only in a high Al content region with low oxygen solubility, and it is suggested in the following ternary phase diagram of Ti—Al—O (X. L. Li, R. Hillel, F. Teyssandier, S. K. Choi, and F. J. J. Van Loo, Acta Metall. Mater., 40 [11] 3147-3157 (1992)) that as the Al content is higher, the oxygen solubility limit decreases. In addition, the deoxidation reaction is a phenomenon developed in a liquid phase and in the case of an Al—Nb—Ti alloy, when Al activity in the alloy melt becomes high, the deoxidation reaction proceeds more significantly. When the Al—Nb—Ti alloy has an Al content of 50 to 75 mass %, an Nb content of 5 to 30 mass % and a total amount of Al and Nb of 80 mass % or less, the deoxidation reaction proceeds basically at a temperature of 1,900 K or more.

In the Al—Nb—Ti alloy, as the reason why the upper limit of the Al content is set to be 75 mass %, the upper limit of the Nb content is set to be 30 mass %, and the total amount of Al and Nb is set to be 80 mass % or less, since the Al—Nb—Ti alloy contains other alloy elements in addition to Nb and Ti or impurities such as oxygen, if the contents of Al and Nb are too large, the proportion of Ti decreases and the alloy cannot be an Al—Nb—Ti alloy.

The deoxidation method of an Al—Nb—Ti alloy of the present invention is described as a method of reducing the oxygen content without causing substantially no volatilization loss of Al, Nb and Ti, and the term "substantially no volatilization loss" indicates that between before and after melting, the difference in Al content is 1.0 mass % or less and the difference in Nb content is 0.5 mass % or less.

In the deoxidation of an Al—Nb—Ti alloy, a flux of CaO alone or a CaO—$CaF_2$ flux obtained by blending more than 0 mass % and 95 mass % or less of calcium fluoride with calcium oxide is added as a deoxidation reaction accelerator, whereby the deoxidation reaction is more promoted.

By the addition of a flux of CaO alone or a CaO—$CaF_2$ flux obtained by blending more than 0 mass % and 95 mass % or less of calcium fluoride with calcium oxide, which does not dissolve in the Al—Nb—Ti alloy, $Al_2O_3$ as a deoxidation product produced during melting of the Al—Nb—Ti alloy produces a compound with CaO or dissolves in CaO—$CaF_2$, causing reduction in $Al_2O_3$ activity and in turn, the deoxidation reaction is further promoted.

In order for the deoxidation reaction to proceed, it is considered that $Al_2O_3$ present in the Al—Nb—Ti alloy must be put into contact with the added flux. It is presumed that since Nb having high specific gravity is added, the specific gravity of the Al—Nb—Ti alloy is larger than the specific gravity of a Ti—Al binary alloy and separation of the Al—Nb—Ti alloy from $Al_2O_3$ and the added flux is prompted, consequently facilitating the contact of $Al_2O_3$ with the flux.

In the case of 0 mass % of calcium fluoride, i.e., CaO alone, the flux has a high melting point and does not melt at a temperature around the melting point of the Al—Nb—Ti alloy but when put into contact with $Al_2O_3$ present in the Al—Nb—Ti alloy, produces a CaO—$Al_2O_3$ compound having a low melting point to reduce the $Al_2O_3$ activity, making it possible to further promote deoxidation. Accordingly, this flux can be used, though its melting point is higher than that of the Al—Nb—Ti alloy.

On the other hand, if the blending amount of calcium fluoride exceeds 95 mass %, contamination by fluorine is generated. Accordingly, in the present invention, a flux of CaO alone or a CaO—$CaF_2$ flux obtained by blending more than 0 mass % and 95 mass % or less of calcium fluoride with calcium oxide is employed.

EXAMPLES

The present invention is described in greater detail below by referring to Examples, but the present invention is not limited to these Examples and can be implemented by appropriately adding changes as long as they comply with the gist of the present invention, and these changes all are included in the technical scope of the present invention.

(Relationship Between Al Content in Al—Nb—Ti Alloy and Oxygen Content Before and after Melting)

Al—Nb—Ti alloys having an oxygen content of 4 to 30 mass % and having various alloy element contents were prepared using an alloy material composed of an aluminum material, a niobium material and a titanium material (titanium oxide or metallic titanium). Deoxidation of each of the prepared Al—Nb—Ti alloys was conducted by melting and then holding the alloy in a 100 kW plasma arc furnace using a water-cooled copper vessel. Here, only Ar was used as the plasma gas, and the pressure during melting was $1.20\times10^5$ Pa.

Figure 2:
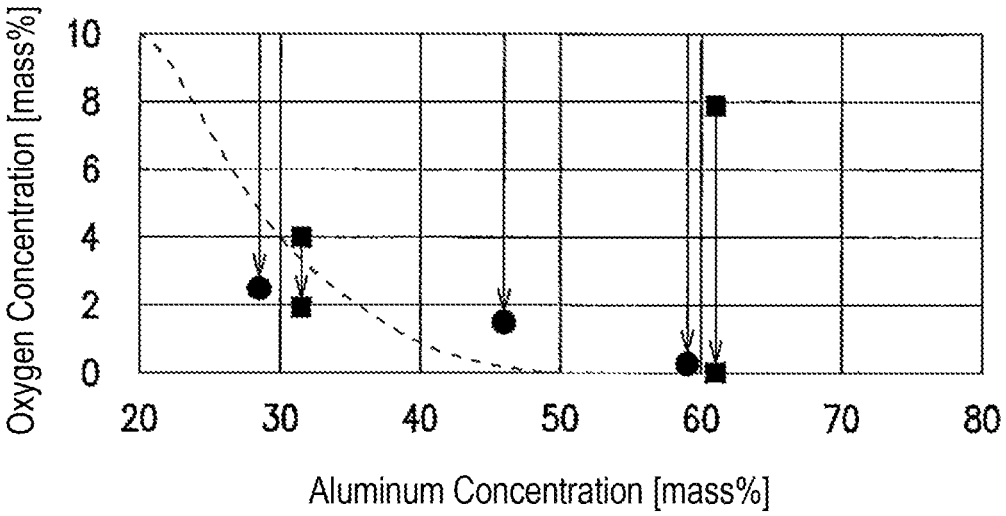
FIG. 2 A graph diagram enlarging the region surrounded by a square of FIG. 1 illustrating the relationship between the Al content in an Al—Nb—Ti alloy and the oxygen content before and after melting.

In order to examine the effect of the Al content of the Al—Nb—Ti alloy on the deoxidation reaction caused by melting, samples were prepared using Al—Nb—Ti alloys having an Al content of 30 mass %, 45 mass %, and 60 mass %, respectively. With respect to the sample using an Al—Nb—Ti alloy having an Al content of 30 mass % or 60 mass %, both a sample using, as the titanium material, titanium oxide and a sample using metallic titanium were made, but with respect to the sample using an Al—Nb—Ti alloy having an Al content of 45 mass %, only a sample using titanium oxide as the titanium material was made. In FIGS. 1 and 2, the sample using titanium oxide and the sample using metallic titanium are denoted by a filled circle mark and a filled square mark, respectively. In these Al—Nb—Ti alloys, as shown in Table 1, the Nb content is from 10 to 20 mass %.

The relationship between the Al concentration (Al content) in the Al—Nb—Ti alloy and the oxygen concentration (oxygen content) before and after melting is illustrated in FIGS. 1 and 2. The upper side (proximal end side) and the lower side (distal end side) of the arrow indicate before melting and after melting, respectively. In FIGS. 1 and 2, with respect to the sample using an Al—Nb—Ti alloy having an Al content of 30 mass % or 60 mass %, the plots are shifted slightly to the left or right for making the filled circle mark and the filled square mark more visible.

The Al—Nb—Ti alloy is basically required to have an oxygen content of 0.1 mass % or less, but according to FIGS. 1 and 2, in all of the samples having an Al content of 30 mass % and 45 mass %, the oxygen content after melting is not 0.1 mass % or less, failing in satisfying the condition that the oxygen content is 0.1 mass % or less. On the other hand, in the sample having an Al content of 60 mass %, the oxygen content after melting is 0.1 mass % or less in the case of using titanium oxide as the titanium material as well as in the case of using metallic titanium, thus satisfying the condition that the oxygen content is 0.1 mass % or less.

The Al deoxidation is governed by Al activity in the titanium alloy, and the Al activity is supposed to have a logarithmic correlation with the Al content. According to M. Maeda et al., Material Science and Engineering, A239-240 (1997), 276-280, the relationship between the oxygen content and the Al content after melting is assumed to become the relationship denoted by the dashed line in FIG. 1.

Extrapolating from this dashed line, it is considered that the oxygen content drops to 0.1 mass % or less after peaking at an Al content of 50 mass %.

(Relationship Between Blended Alloy Concentration Before Melting and Alloy Concentration after Melting)

In addition, the relationship between the blended alloy concentration before melting (deoxidation) of the Al—Nb—Ti alloy and the alloy concentration after melting (deoxidation) was examined. The relationship between the contents of Al and Nb before melting of the Al—Nb—Ti alloy and the contents of Al and Nb after melting are shown in Table 1. Here, those denoted by No. with suffix "a" indicate a sample using titanium oxide as the titanium material, and those denoted by No. with suffix "b" indicate a sample using metallic titanium as the titanium material.

TABLE 1

| | Before Melting (mass %) | | After Melting (mass | | |
|---|---|---|---|---|---|
| No. | Al | Nb | Al | Nb | Remarks |
| 1a | 30 | 10 | 32 | 8.6 | Comparative Example |
| 1b | 30 | 10 | 27.8 | 10.8 | Comparative Example |
| 2a | 45 | 15 | 45.8 | 15.4 | Comparative Example |
| 3a | 60 | 20 | 59.6 | 20.2 | Invention Example |
| 3b | 60 | 20 | 60.7 | 20.3 | Invention Example |

In the case of an Al—Nb—Ti alloy having an Al content of 30 mass %, the difference in the content was from 2.0 to 2.2 mass % for Al and from 0.8 to 1.4 mass % for Nb, and deviation from the target composition was thus caused after melting. In the case of an Al—Nb—Ti alloy having an Al content of 45 mass %, the difference in the content was 0.8 mass % for Al and 0.4 mass % for Nb, and the deviation from the target composition was small after melting, but as described above, since the Al content was small, the oxygen content was not reduced to 0.1 mass % or less.

On the other hand, in the case of an Al—Nb—Ti alloy having an Al content of 60 mass %, the deviation after melting was kept to a level where the change in content was from 0.4 to 0.7 mass % for Al and from 0.2 to 0.3 mass % for Nb. This result indicates that in the case of an Al—Nb—Ti alloy having an Al content of 60 mass %, the Al content was large enough to reduce all Nb oxide.

Examples with Addition of Flux (Relationship Between Al Content in Al—Nb—Ti Alloy and Oxygen Content Before and after Melting)

With respect to each of two kinds of Al—Nb—Ti alloys (Ti-60 mass % Al-20 mass % Nb alloy, Ti-40 mass % Al-10 mass % of Nb alloy), a total of 5 alloys were prepared to have various blended oxygen concentrations as shown in Table 2 by using an alloy material composed of an aluminum material, a niobium material (niobium oxide) and a titanium oxide. The blended oxygen concentration of each alloy is shown in Table 2. Five Al—Nb—Ti alloys prepared were melted in a 10 kW plasma arc furnace using a water-cooled copper vessel, and after adding flux as a deoxidation reaction accelerator to each melt (in No. 1, the flux was not added), they were held to conduct deoxidation of the Al—Nb—Ti alloy. Here, only Ar was used as the plasma gas, and the pressure during melting was $1.20\times10^5$ Pa.

As for the flux added, two kinds of fluxes, i.e., a CaO—$CaF_2$ flux obtained by blending 80 mass % of calcium fluoride with calcium oxide and a flux of CaO alone not blended by calcium fluoride, were used.

Figure 3:
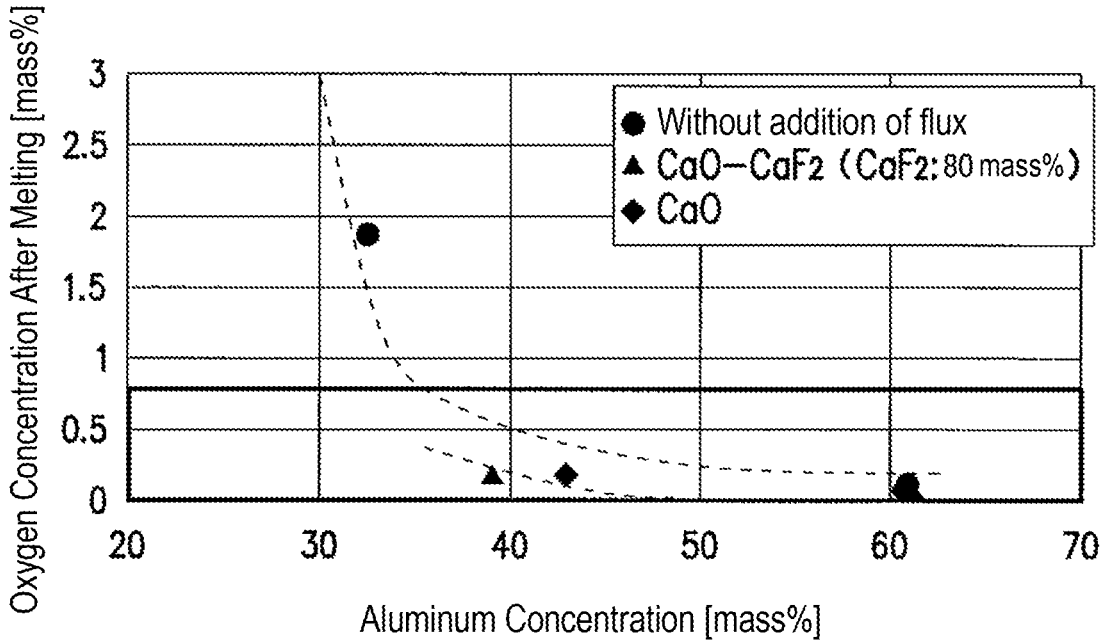
FIG. 3 A graph diagram illustrating the relationship between the Al content in an Al—Nb—Ti alloy and the oxygen content before and after melting, including addition or no addition of flux.
Figure 4:
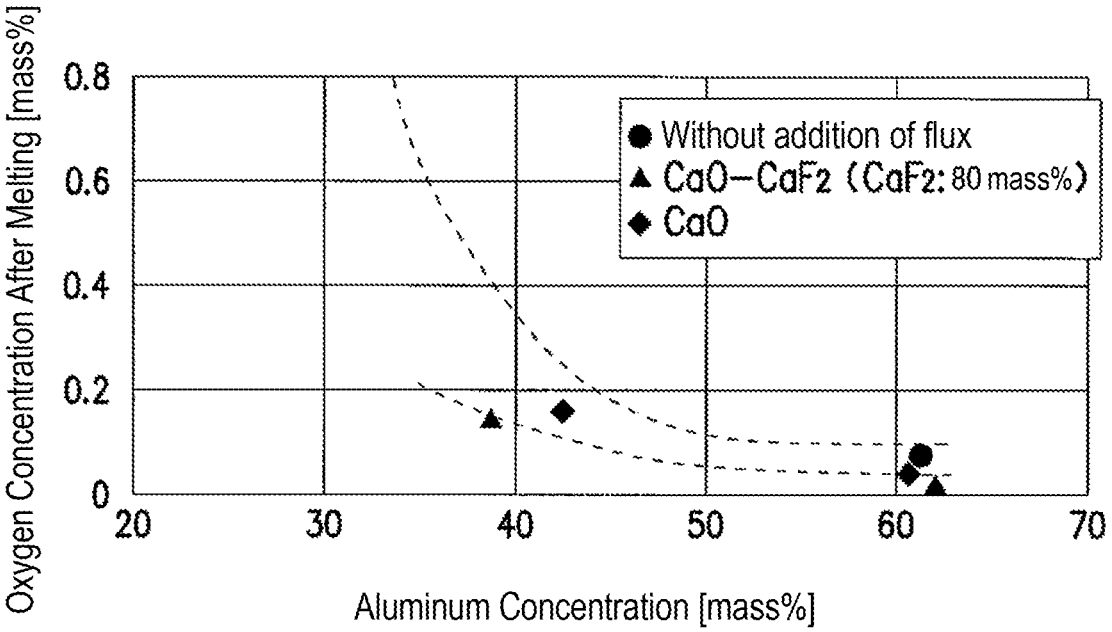
FIG. 4 A graph diagram enlarging the region surrounded by a square of FIG. 3 illustrating the relationship between the Al content in an Al—Nb—Ti alloy and the oxygen content before and after melting.

The relationship between the Al concentration (Al content) and the oxygen concentration (oxygen content) after melting of the Al—Nb—Ti alloy is illustrated in FIGS. 3 and 4 and shown in Table 2. In FIGS. 3 and 4, the results of Example without addition of flux are illustrated together, and the results of Example (Ti-33 mass % Al-10 mass % Nb alloy, blended oxygen concentration: 4.0 mass %) without addition of flux, which is not shown in Table 2, are also illustrated.

As described above, the Al—Nb—Ti alloy is basically required to have an oxygen content of 0.1 mass % or less. In the sample of No. 1 without addition of flux, since the Al content is 60 mass %, the oxygen content after melting is 0.076 mass %, and the condition that the oxygen content is 0.1 mass % or less is satisfied, but in the sample of No. 4 added with a flux of CaO alone, the oxygen content after melting was 0.036 mass % and in the sample of No. 5 added with a CaO—$CaF_2$ flux obtained by blending 80 mass % of calcium fluoride with calcium oxide, the oxygen content after melting was 0.018 mass %, revealing that deoxidation was further promoted.

TABLE 2

| No. | Alloy Species | Flux | Blended Oxygen Concentration (mass %) | Oxygen Concentration After Melting (mass %) |
|---|---|---|---|---|
| 1 | Ti-60 mass % Al-20 mass % Nb | none | 7.3 | 0.076 |
| 2 | Ti-40 mass % Al-10 mass % Nb | CaO | 2.4 | 0.16 |
| 3 | Ti-40 mass % Al-10 mass % Nb | CaO-$CaF_2$ ($CaF_2$: 80 mass %) | 0.8 | 0.14 |
| 4 | Ti-60 mass % Al-20 mass % Nb | CaO | 2.5 | 0.036 |
| 5 | Ti-60 mass % Al-20 mass % Nb | CaO-$CaF_2$ ($CaF_2$: 80 mass %) | 2.5 | 0.018 |

While the invention has been described in detail and with reference to specific embodiments thereof, it will be apparent to one skilled in the art that various changes and modifications can be made therein without departing from the spirit and scope of the invention.

This application is based on Japanese Patent Application No. 2014-224360 filed on Nov. 4, 2014, Japanese Patent Application No. 2015-078626 filed on Apr. 7, 2015, and Japanese Patent Application No. 2015-159315 filed on Aug. 12, 2015, the contents of which are incorporated herein by way of reference.

INDUSTRIAL APPLICABILITY

According to the present invention, an Al—Nb—Ti alloy having a low oxygen content can be produced at a low cost, and this alloy is mixed with Ti having a small oxygen content, whereby a Ti—Al—Nb alloy containing Ti as its main component can be produced at a relatively low cost.

The invention claimed is:

1. A method for deoxidizing an Al—Nb—Ti alloy, the method comprising:

melting and holding the Al—Nb—Ti alloy by a melting method using a water-cooled copper vessel in an atmosphere of 1.33 Pa to $2.67\times10^5$ Pa at a temperature of 1,900 K or more, thereby decreasing an oxygen content thereof to 0.1 mass % or less, wherein the Al—Nb—Ti alloy is prepared from materials comprising an aluminum material, a niobium material and a metallic titanium material, and the Al—Nb—Ti alloy comprises from 50 to 75 mass % of Al, from 5 to 30 mass % of Nb, 80 mass % or less in total of Al and Nb, and 2.5 mass % to 30 mass % of oxygen, the remainder being titanium and impurities.

2. The method according to claim 1, wherein a flux of CaO alone or a CaO—$CaF_2$ flux obtained by blending more than 0 mass % and 95 mass % or less of calcium fluoride with calcium oxide is added during the melting of the Al—Nb—Ti alloy.

3. The method according to claim 1, wherein the melting method is an arc melting method, a plasma arc melting method or an induction melting method.

4. The method according to claim 2, wherein the melting method is an arc melting method, a plasma arc melting method or an induction melting method.

5. The method according to claim 1, wherein the Al—Nb—Ti alloy comprises from 60 to 75 mass % of Al.

6. The method according to claim 1, wherein the melting and holding are performed such that a difference of an amount of Al in the Al—Nb—Ti alloy before and after the melting and holding is 1.0 mass % or less.

7. The method according to claim 1, wherein the melting and holding are performed such that the oxygen content of the Al—Nb—Ti alloy after the melting and holding is 0.076 mass % or less.

8. The method according to claim 1, wherein the melting and holding are performed such that a difference of an amount of Al in the Al—Nb—Ti alloy before and after the melting and holding is 1.0 mass % or less and that the oxygen content of the Al—Nb—Ti alloy after the melting and holding is 0.076 mass % or less.

9. The method according to claim 1, wherein the alloy material contains oxygen in the total amount of 7.3 mass % or more.

10. The method according to claim 1, wherein the niobium material is lower niobium or niobium oxide ore.

11. The method according to claim 1, wherein the melting and holding process is performed at $1.20\times10^5$ Pa to $2.67\times10^5$ Pa.

12. The method according to claim 1, wherein the titanium material is free of titanium oxide.

13. The method according to claim 2, wherein the melting and holding are performed such that the oxygen content of the Al—Nb—Ti alloy after the melting and holding is 0.036 mass % or less.

* * * * *